US007210871B2

(12) United States Patent
Slatter

(10) Patent No.: US 7,210,871 B2
(45) Date of Patent: May 1, 2007

(54) SWIVELLING FITTINGS

(75) Inventor: Stephen O. Slatter, Sunrise, FL (US)

(73) Assignee: Taco Metals, Inc., Miami, FL (US)

( * ) Notice: Subject to any disclaimer, the term of this patent is extended or adjusted under 35 U.S.C. 154(b) by 212 days.

(21) Appl. No.: 10/852,567

(22) Filed: May 24, 2004

(65) Prior Publication Data

US 2004/0234330 A1 Nov. 25, 2004

Related U.S. Application Data

(60) Provisional application No. 60/473,295, filed on May 23, 2003.

(51) Int. Cl.
*F16D 11/00* (2006.01)

(52) U.S. Cl. ..... 403/129; 403/128; 403/131; 403/322.1; 403/322.2; 403/325; 114/343; 114/364

(58) Field of Classification Search ..... 403/128, 403/129, 131, 322.1, 322.2, 325, 123; 114/343, 114/364

See application file for complete search history.

(56) References Cited

U.S. PATENT DOCUMENTS

| | | | | |
|---|---|---|---|---|
| 4,201,400 | A * | 5/1980 | Hoogenbosch | 403/131 |
| 4,522,421 | A * | 6/1985 | Vance | 403/131 |
| 5,741,022 | A * | 4/1998 | Wass et al. | 403/131 |
| 6,783,144 | B2 * | 8/2004 | McCoy et al. | 280/511 |

* cited by examiner

*Primary Examiner*—Daniel P. Stodola
*Assistant Examiner*—Michael P Ferguson
(74) *Attorney, Agent, or Firm*—Robert M. Schwartz; Alfred K. Dassler

(57) ABSTRACT

A swiveling fitting for multi-directional movement includes a housing having a bore therethrough to accommodate a button shaft. A ball housing receives at least a portion of the button shaft. The ball housing has at least one ball recess to accommodate at least one ball. A locking sphere receives at least a portion of the ball housing. The locking sphere has at least one groove to accommodate the at least one ball, and a baseplate for moveably securing the locking sphere. The baseplate is releasably securable to a substrate.

18 Claims, 9 Drawing Sheets

SWIVELLING FITTINGS

CROSS-REFERENCE TO RELATED APPLICATIONS

This application claims the benefit of U.S. Provisional Application Ser. No. 60/473,295, filed on May 23, 2003, entitled SWIVELLING FITTINGS.

TECHNICAL FIELD OF THE INVENTION

This invention relates to the field of boating, and particularly to a frame mounting system having a base plate and detachably mating fittings capable of attachment to a framework of tubing on a boat.

BACKGROUND OF THE INVENTION

Various types of structures that are generally referred to as towers are in use on recreational and pleasure boats. The towers are typically fabricated from metal tubing or pipe. The towers form a structure over part of the deck surface of the boat. The tower is typically fastened to some part of the deck of the boat and extends upward from the deck surface. The towers are also known to those of ordinary skill in the art variously as arches, half towers, tuna towers, towers, hardtops, and hardtop support systems. The towers can be used to provide sunshade, shelter from the elements, mounting points for a variety of equipment for various purposes, and additional control stations.

The present invention is directed to a device for permitting multi-directional movement of the tubing framework and for easily mounting, removing and replacing tubing on boats. In the prior methods and devices for attaching these structures to boat decks, the most common method is to utilize mating male and female fittings. Generally, in the prior methods, the female fitting is attached in some manner to the upper surface of the boat deck. The towers all have several legs that form the mounting points on the deck. In order to be able to place and withdraw the male component from the female component of the fitting, it is necessary for the female component of the fittings to all have the same directional orientation. One problem with creating the proper orientation is that the deck mounting surfaces on many boats is generally not flat but varies over its surface at some angle to the horizontal. Due to this variation in the deck surface, it is difficult to install the plurality of fittings with a uniform vertical orientation for the female fitting. Consequently, mounting and removing the towers can be difficult.

The prior art presents a variety of approaches that have been engaged to mount, remove and replace tubing on boats. Notwithstanding these efforts to provide suitable mounts and fittings, the existing prior art devices are limited in numerous respects. Accordingly, what is lacking that the prior art has not provided is a simple fitting that provides for multi-directional movement of the tubing framework.

SUMMARY OF THE INVENTION

The present invention eliminates the above-mentioned needs for fitting by providing a swiveling fitting that provides for multi-directional movement of the tubing framework, including rotational movement.

In accordance with the present invention, there is provided a swiveling fitting for multi-directional movement including a housing having a bore there through to accommodate a button shaft, a ball housing for receiving at least a portion of the button shaft, the ball housing having at least one ball recess to accommodate at least one ball, a locking sphere for receiving at least a portion of the ball housing, the locking sphere having at least one groove to accommodate the at least one ball, and a base plate for moveably securing the locking sphere, wherein the base plate is releasably securable to a substrate.

DETAILED DESCRIPTION OF THE INVENTION

Figure 1:
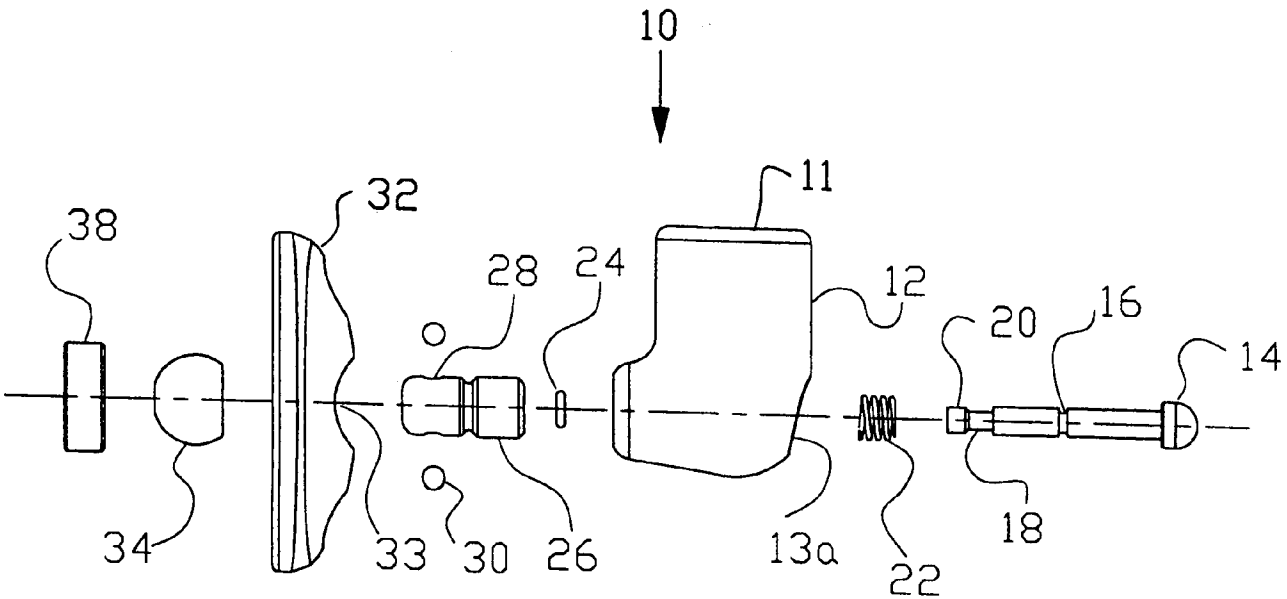
FIG. 1 is an exploded side view illustration of the preferred embodiment of the present invention.
Figure 2A:
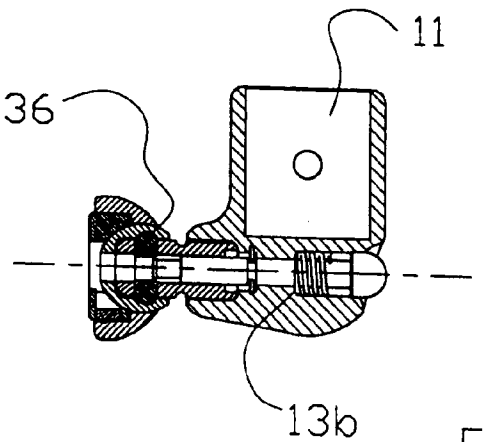
FIG. 2 is a side view of the preferred embodiment of the present invention of FIG. 1.

Referring now to FIGS. 1 and 2, a preferred embodiment of the present invention is illustrated as swiveling 10. Swiveling fitting 10 includes a housing 12, a button shaft 14, a ball housing 26, a base plate 32, and a locking sphere 34.

Housing 12 includes a cavity 11 for receiving tubing and a bore 13 for accommodating button shaft 14. Bore 13 is constructed so as to form a support for shaft spring 22 to rest upon. In operation, shaft spring 22 is positioned within bore 13 and button shaft 14 is passed through shaft spring 22 and bore 13.

Once partially through shaft spring 22 and bore 13, at least a portion of button shaft 14 is received by ball housing 26. Ball housing 26 incorporates at least one ball recess 28 to accommodate at least one ball 30. Ball 30 is capable of at least partially passing into at least one ball recess 28, contacting button shaft 14 at, depending upon the position of button shaft 14, shaft recess 18 or shaft ridge 20 (discussed below).

To prevent the unintended removal of button shaft 14 from bore 13 as a result of spring 22 returning to an uncompressed state, a shaft clip 24 is operatively engaged to button shaft 14 at shaft clip recess 16. Bore 13 is further constructed so as to form a stop for shaft clip 24 to rest upon, thus preventing unintended removal of button shaft 14.

At least a portion of ball housing 26 is received by locking sphere 34. Locking sphere 34 incorporates a groove 36 that is capable of accommodating at least one ball 30. Locking sphere is at least partially covered by a base plate 32, which incorporates an opening 33 so as to permit some exposure of locking sphere 34. Locking sphere 34 is supported within base plate 32 by a sphere thrust 38. Sphere thrust 38 provides an elevated surface that permits locking sphere 34 to protrude out of opening 33 of base plate 32.

Figure 3B:
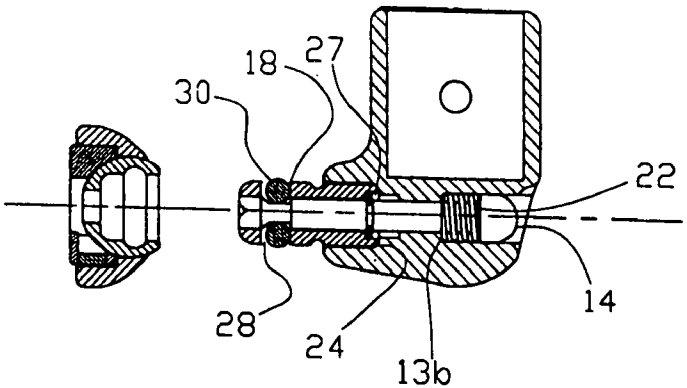
FIG. 3*b* is a side view illustration of the preferred embodiment of the present invention of FIG. 2 with the button shaft depressed.
Figure 3D:
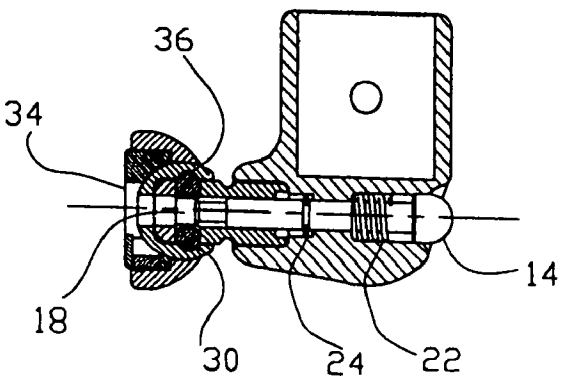
FIG. 3*d* is a side view illustration of the preferred embodiment of the present invention of FIG. 2 in the fully engaged and secured position.
Figure 3A:
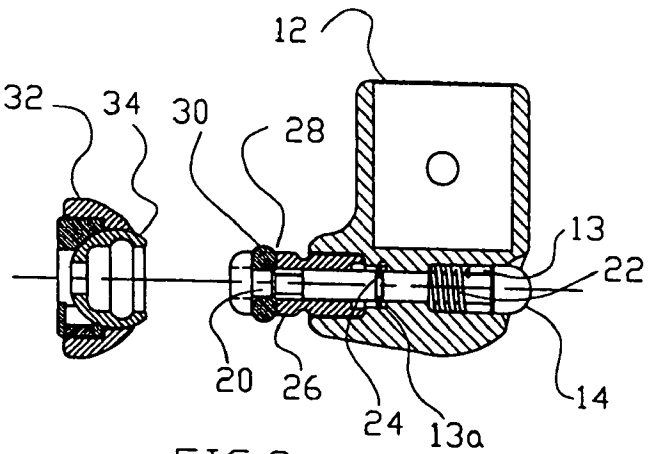
FIG. 3*a* is a side view illustration of the preferred embodiment of the present invention of FIG. 2 in the fully disengaged position.

Referring now to FIGS. 3*a*, 3*b*, 3*c*, and 3*d*, the preferred embodiment of the present invention is illustrated in operation. FIG. 3*a* shows swiveling fitting 10 in a disengaged, resting state. As is demonstrated in FIG. 3*a*, shaft spring 22 is in an uncompressed state, resulting in button shaft 14 residing in a position of bore 13 that is a result of shaft clip 24 contacting against housing shoulder 13*a* of housing 12. This position finds ball 30 passing partially into ball housing recess 28 of ball housing 26 and abutting shaft ridge 20 of button shaft 14. Ball housing 26 is further shown in operative engagement with housing 12.

As shown in FIG. 3*b*, once button shaft 14 is depressed, shaft spring 22 is compressed, resulting in button shaft 14 passing further into ball housing 26. Shaft spring 22 is compressed against housing shoulder 13*b* of housing 12, which prevents shaft spring 22 from traveling further along bore 13. The depression of button shaft 14 results in ball 30 passing further into ball housing recess 28 of ball housing 26 and thereby abutting shaft recess 18 of button shaft 14. So as to prevent excessive depression of button shaft 14, shaft clip 24 will contact ball housing shoulder 27 of ball housing 26 in a manner that prevents button shaft 14 from further travel through bore 13 along the direction of depression.

Figure 3C:
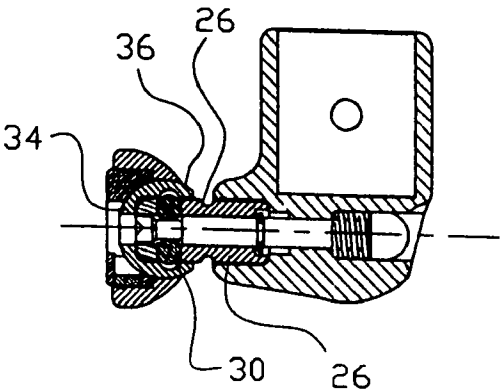
FIG. 3*c* is a side view illustration of the preferred embodiment of the present invention of FIG. 2 with the ball housing received by the locking sphere.

Referring now to FIG. 3*c*, due to ball 30 passing further into ball housing recess 28 of ball housing 26 and thereby abutting shaft recess 18 of button shaft 14, locking sphere 34 can be engaged. Locking sphere 34 is engaged by ball housing 26, and, as is illustrated in FIG. 3*d*, is secured by ball 30 entering groove 36 when button shaft 14 is released and shaft spring 22 is decompressed, causing ball 30 to move out of shaft recess 18 and onto shaft ridge 20. The abutting relationship between shaft ridge 20 and ball 30 results in ball 30 entering into groove 36, securing housing 12 to locking sphere 34 and thereby permitting multi-directional movement of swiveling fitting 10.

Figure 4:
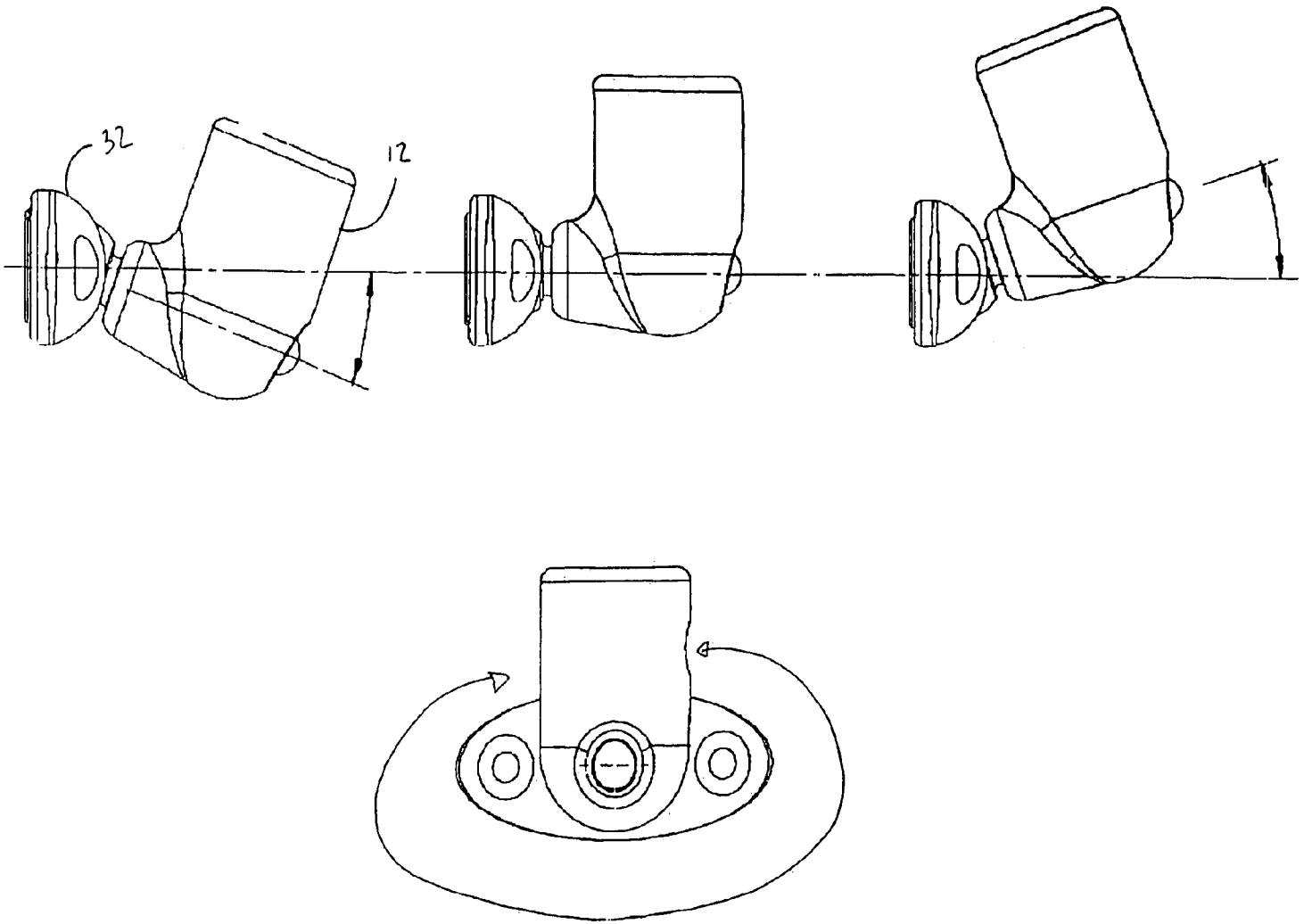
FIG. 4 is a side view illustration of the preferred embodiment of the present invention of FIG. 2 showing multi-directional movement.

An example of such multi-directional movement is illustrated in FIG. 4. As is shown in FIG. 4, housing 12 is capable of adjustment into a vast array of positions with respect to an axis, such as a longitudinal axis, of base plate 32. Preferably, housing 12 of swiveling fitting 10 is capable of 360° rotation about a longitudinal axis of bore 13. Additionally, locking sphere 34 is capable of adjustment, preferably between 1° and 180°, with respect to the longitudinal axis of base plate 32, more preferably between 30° and 150°, and most preferably between 70° and 110°.

Figure 5:
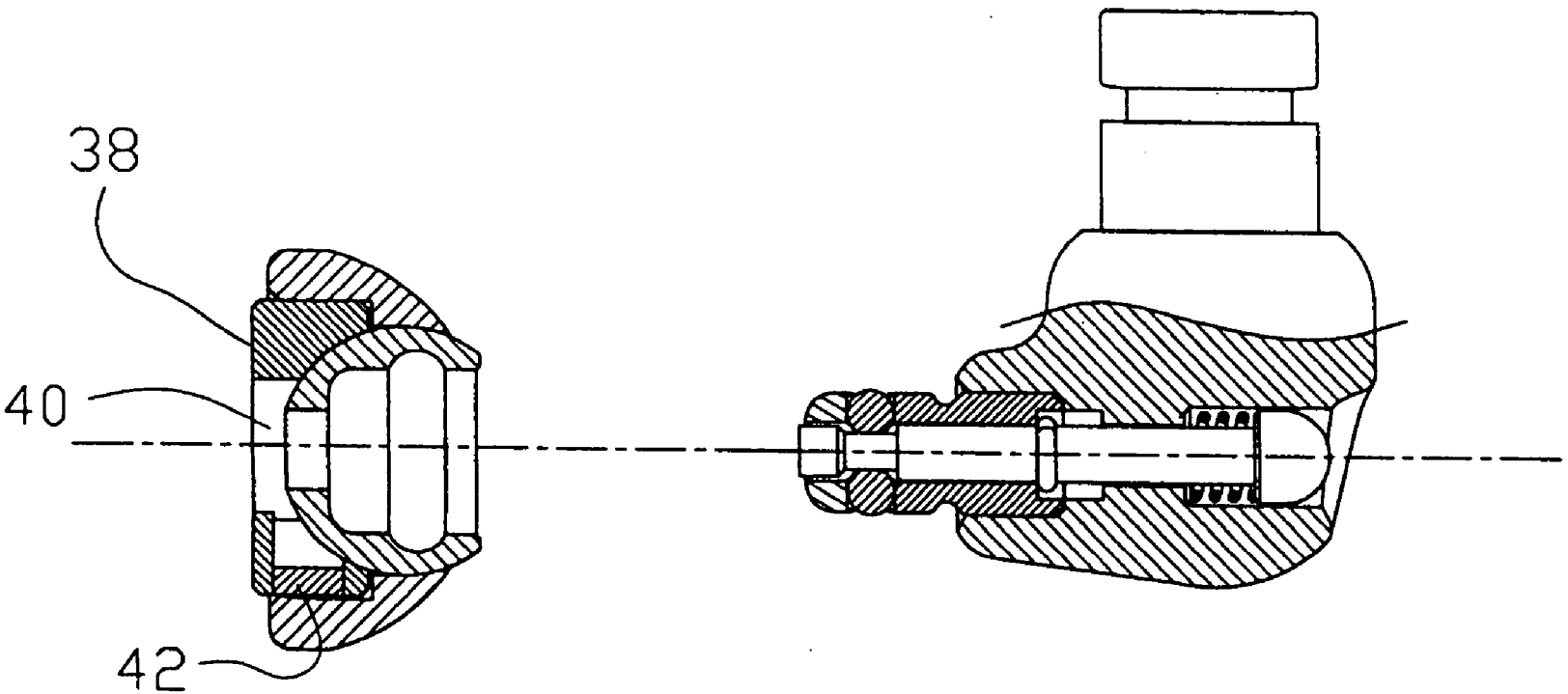
FIG. 5 is a side view illustration of a sphere thrust of the present invention of FIG. 1.

Referring now to FIG. 5, sphere thrust 38 is illustrated. Preferably, sphere thrust 38 includes a central bore 40 to accommodate at least a portion of locking sphere 34. Additionally, it is preferred that sphere thrust 38 is formed from a flexible material having a coefficient of friction substantially equal to rubber or the like. The combination of flexibility and high coefficient of friction results in a sphere thrust that supports locking sphere 34 and resists unintended motion of locking sphere 34. Furthermore, sphere thrust 38 can be provided with a drainage port 42 to prevent a build-up of excessive moisture, permitting such moisture to be released into the outside atmosphere.

Figure 6:
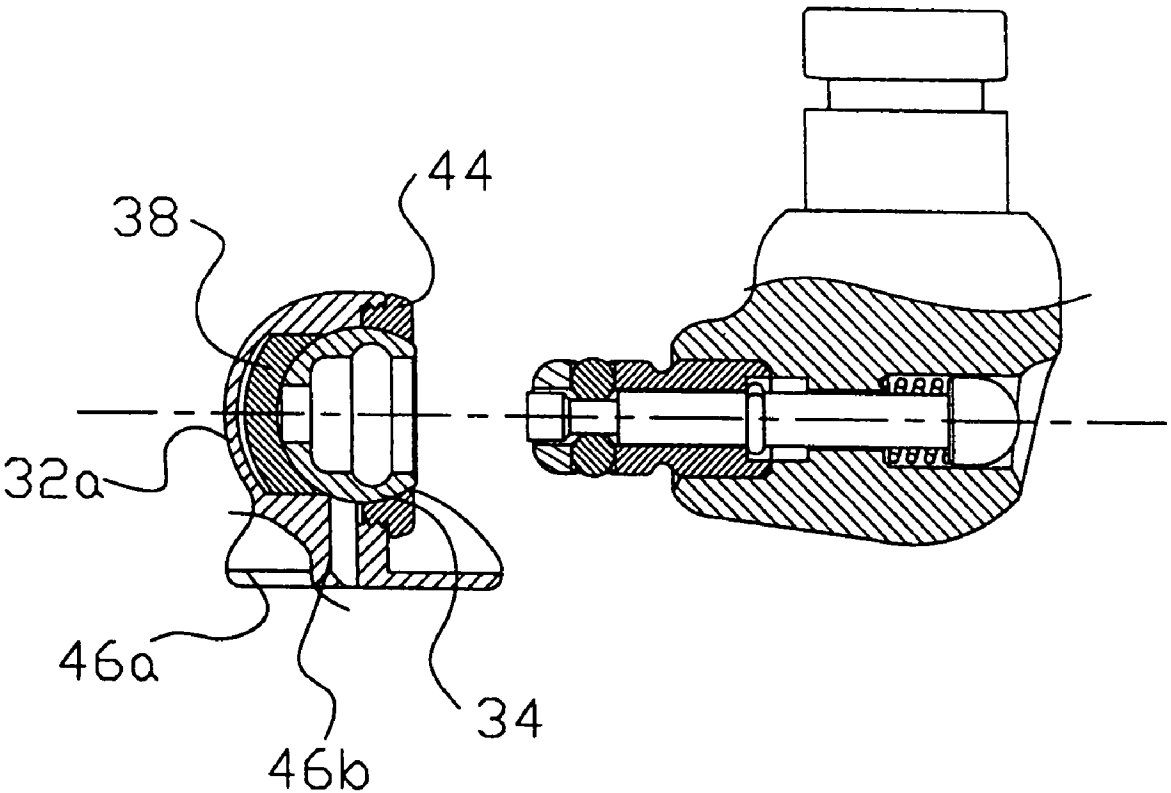
FIG. 6 is a side view illustration of alternative embodiment of the present invention of FIG. 1.

Referring now to FIG. 6, an alternative base plate 32*a* is shown. Alternative base plate 32*a* encloses sphere thrust 38 and supports locking sphere 34. Locking sphere 34 is retained in its relationship with alternative base plate 32*a* by sphere retainer 44, which can be threaded to be received by a corresponding thread in alternative base plate 32*a*. Additionally, alternative base plate 32*a* can incorporate moisture drainage channels 46*a* and 46*b* to prevent a build-up of excessive moisture, permitting such moisture to be released into the outside atmosphere.

Figure 7A:
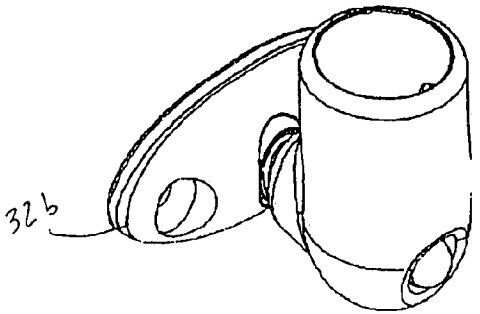
FIG. 7*a* is a side view illustration of alternative embodiment of the present invention of FIG. 1
Figure 7C:
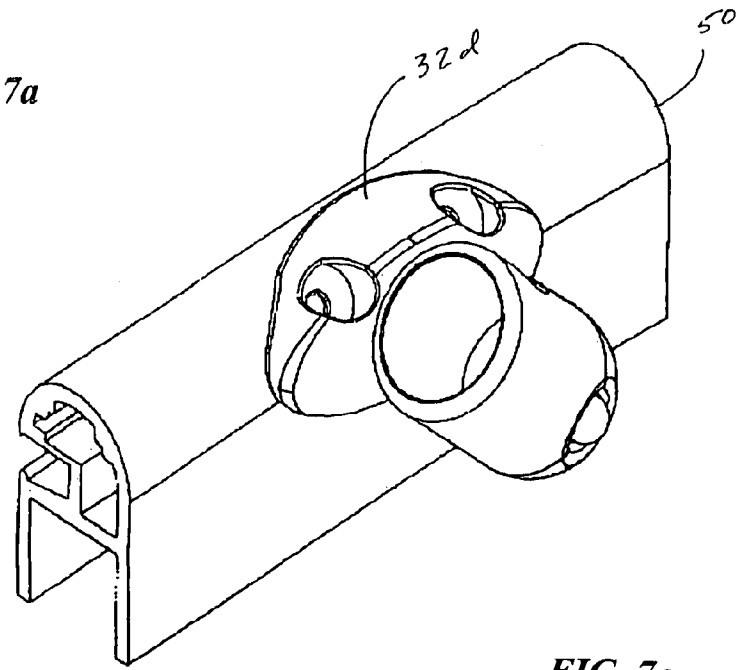
FIG. 7*c* is a side view illustration of alternative embodiment of the present invention of FIG. 1
Figure 7B:
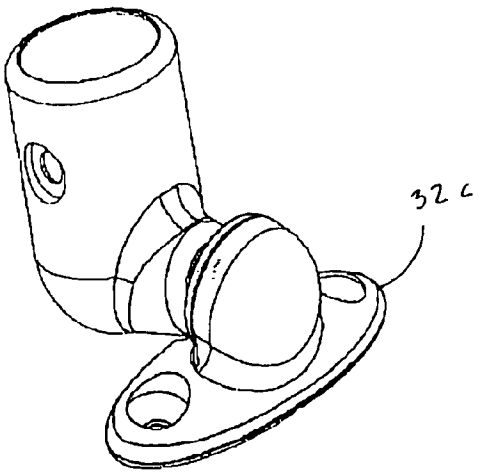
FIG. 7*b* is a side view illustration of alternative embodiment of the present invention of FIG. 1

FIGS. 7*a*, 7*b*, and 7*c* illustrate alternative base plate arrangements, thereby permitting attachment to various surfaces. For example, FIG. 7*a* shows a base plate 32*b* that is capable of mounting onto a vertical surface, such as a sidewall of a structure. FIG. 7*b* illustrates a base plate 32*c* that is capable of mounting onto a horizontal surface, such as a top of a structure. Additionally, FIG. 7*c* demonstrates a base plate 32*d* that is capable of mounting onto a curved surface, such as a windshield support 50 of a boat.

Figure 8:
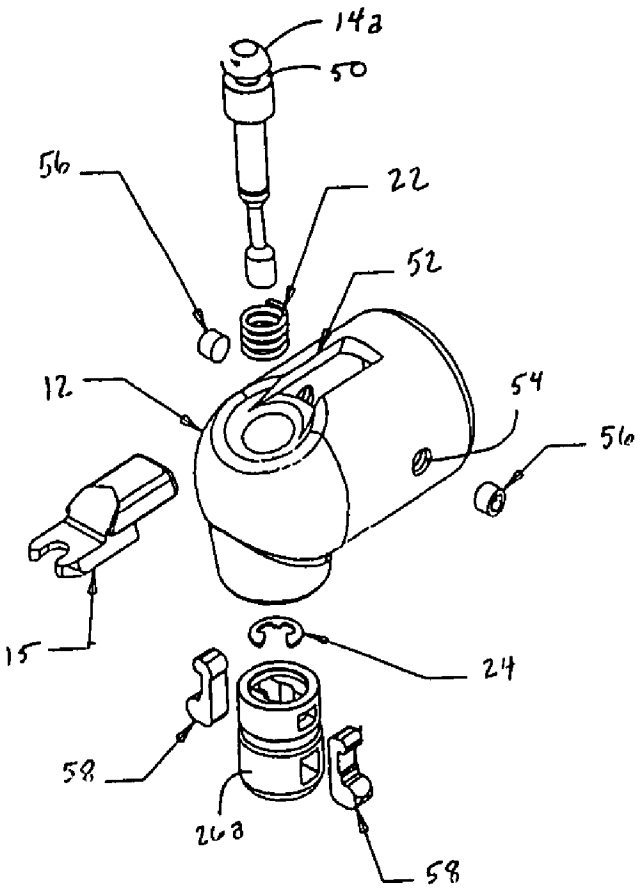
FIG. 8 is an exploded isometric view illustration of alternative embodiment of the present invention of FIG. 1.

Referring now to FIG. 8, an alternative embodiment of the present invention is illustrated as incorporating safety clip 15. When in the secured position (shown in FIG. 11) safety clip 15 prevents unintended depression of button shaft 14, as defined below, thereby preventing a releasing of its engagement from a locking sphere, such as locking sphere 34. This prevents the tubing (not shown) engaged to housing 12 from undesired motion.

Figure 9:
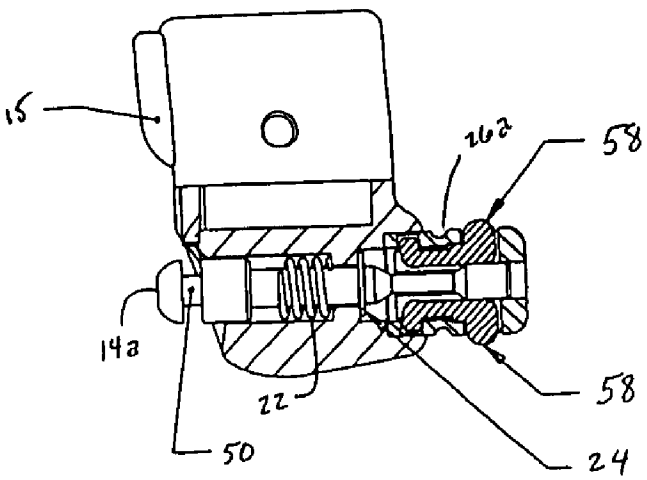
FIG. 9 is a side view illustration of the present invention of FIG. 8.
Figure 11:
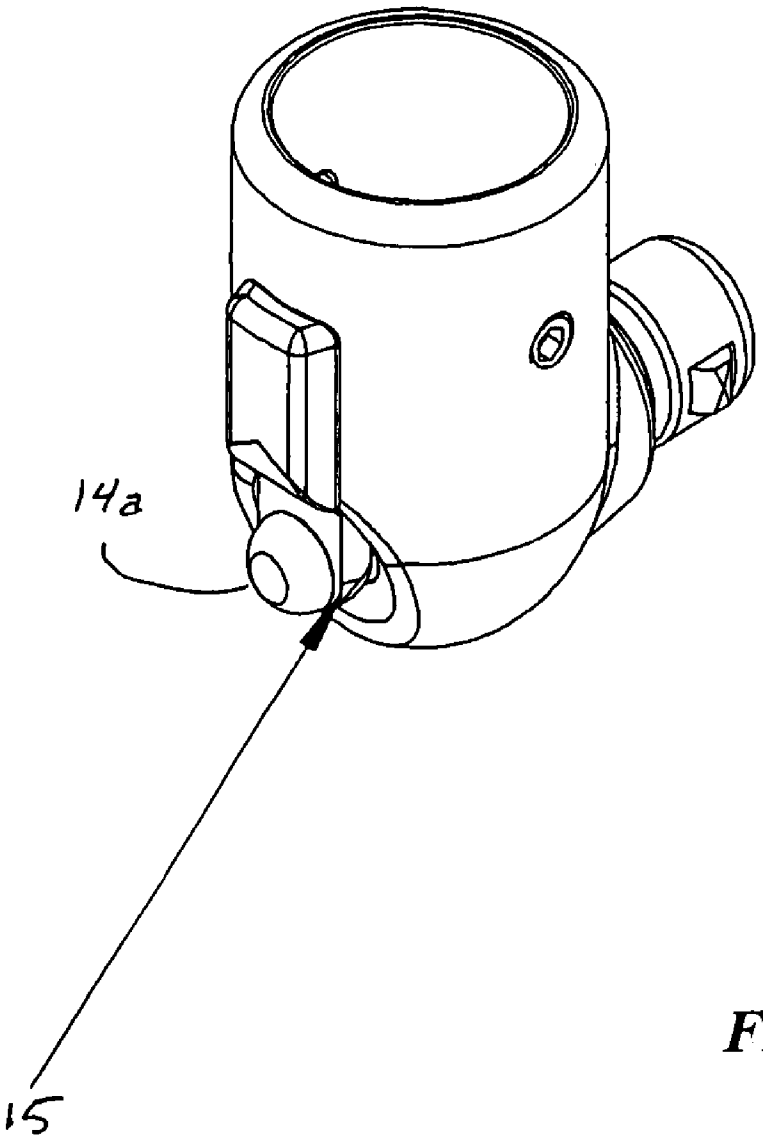
FIG. 11 is an isometric view illustration of the present invention of FIG. 10.

As is further shown in FIGS. 8 and 9, alternative button shaft 14*a* incorporates a groove 50 for receiving safety clip 15. As illustrated in FIG. 11, safety clip 15 slidably engages groove 50, thereby preventing button shaft 14*a* from being depressed. Moving safety clip 15 from its sliding engagement with groove 50 permits button shaft 14*a* to be depressed.

Referring again to FIG. 8, housing 12 accommodates safety clip 15 in slide 52. Housing further incorporates threaded side bores 54 to receive grub screws 56. Grub screws 56 can be used to tighten a friction fit between housing 12 and tubing of a frame. As detailed above, a spring 22 receives button shaft 14*a*. In this embodiment, button shaft 14*a* engages a lever housing 26*a* accommodating lever locks 58. As illustrated in FIG. 9, when button shaft 14*a* is in the resting state, shaft ridge 20*a* abuts lever locks 58. As a result of the abutting relationship with shaft ridge 20*a*, lever locks 58 protrude out of lever housing 26*a* sufficiently to engage a locking sphere, such as locking sphere 34 of FIG. 1.

Figure 10:
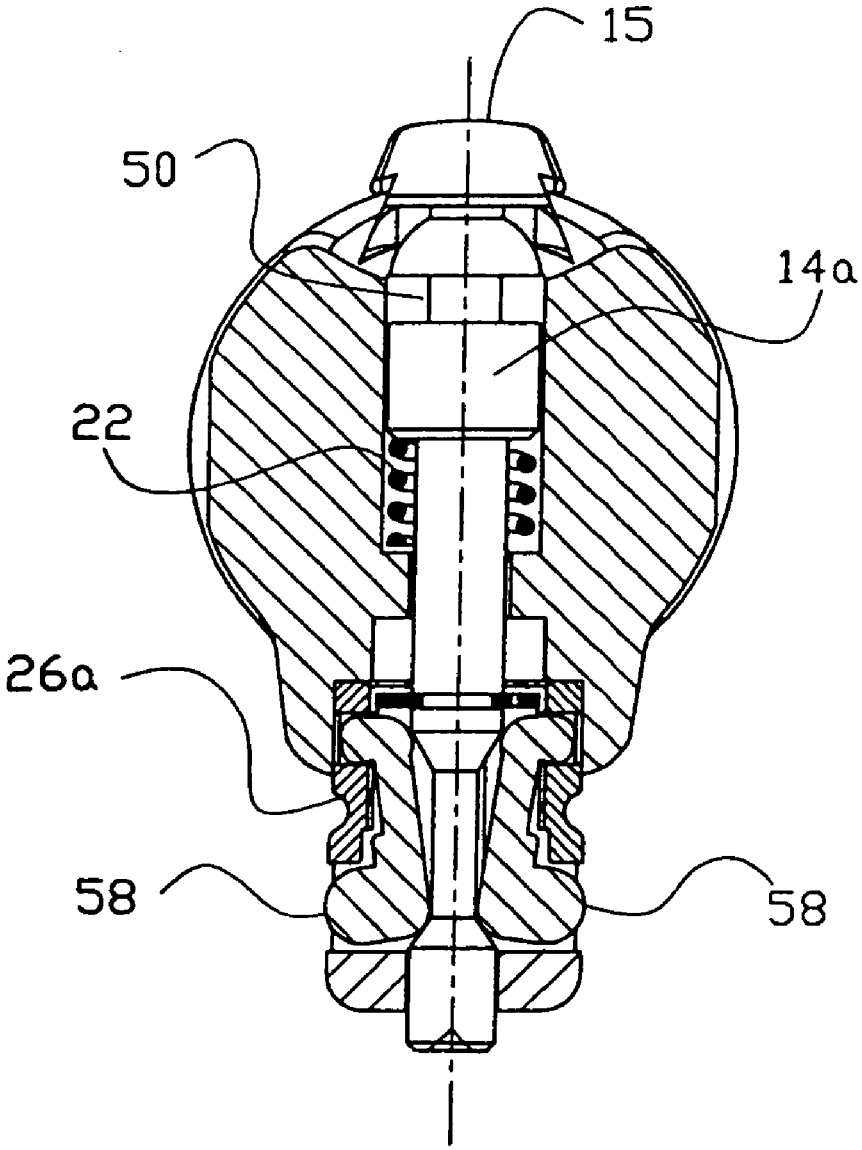
FIG. 10 is a rear view illustration of the present invention of FIG. 9.

Once button shaft 14*a* is depressed, as illustrated in FIG. 10, shaft ridge 20*a* depresses as well, thereby causing lever locks 58 to abut shaft recess 18*a*. Thus, lever locks 58 travel further internal of lever housing 26*a*, thereby permitting disengagement from a locking sphere as detailed above.

Although only a few exemplary embodiments of the present invention have been described in detail above and in the following Figures, those skilled in the art will readily appreciate that numerous modifications to the exemplary embodiments are possible without materially departing from the novel teachings and advantages of this invention.

Accordingly, all such modifications are intended to be included within the scope of this invention as defined in the following claims.

What is claimed is:

1. A swiveling fitting for multi-directional movement comprising:

a housing having a bore therethrough, said bore having a shoulder formed therein, and said bore accommodating a button shaft, said button shaft having a shaft recess and a shaft ridge;

a shaft spring disposed in said bore and abutting said shoulder, said button shaft passing at least partially through said shaft spring;

a ball housing for receiving at least a portion of said button shaft, said ball housing having at least one ball recess;

a ball disposed in each said at least one ball recess;

a locking sphere for receiving at least a portion of said ball housing, said locking sphere having at least one groove to accommodate said at least one ball; and when said ball is engaged by said shaft ridge a baseplate for moveably securing said locking sphere, wherein said baseplate is releasably securable to a substrate.

2. The swiveling fitting according to claim 1 wherein said housing includes a cavity to engage tubing.

3. The swiveling fitting according to claim 1 wherein said shaft recess accommodates said at least one ball.

4. The swiveling fitting according to claim 3 wherein said shaft recess accommodates said at least one ball when said shaft spring is compressed by a depression of said button shaft.

5. The swiveling fitting according to claim 4 wherein said shaft ridge abuts said at least one ball when said shaft spring is decompressed.

6. The swiveling fitting according to claim 5 wherein said at least one groove accommodates said at least one ball when said shaft spring is decompressed.

7. The swiveling fitting according to claim 6 wherein said base plate incorporates a sphere thrust.

8. The swiveling fitting according to claim 7 wherein said sphere thrust is flexible.

9. The swiveling fitting according to claim 8 wherein said sphere thrust is rubber.

10. The swiveling fitting according to claim 1 wherein said housing rotates 360° about a longitudinal axis of said bore.

11. The swiveling fitting according to claim 1 wherein said locking sphere rotates between about 1° and 180° about a longitudinal axis of said base plate.

12. The swiveling fitting according to claim 11 wherein said locking sphere rotates between about 30° and 150° about a longitudinal axis of said base plate.

13. The swiveling fitting according to claim 12 wherein said locking sphere rotates between about 70° and 110° about a longitudinal axis of said base plate.

14. The swiveling fitting according to claim 9 wherein said sphere thrust incorporates a drainage port.

15. The swiveling fitting according to claim 1 wherein said base plate incorporates a drainage port.

16. The swiveling fitting according to claim 1 wherein said base plate is mounted on a vertical surface.

17. The swiveling fitting according to claim 1 wherein said base plate is mounted on a horizontal surface.

18. The swiveling fitting according to claim 1 wherein said base plate is mounted on a curved surface.

* * * * *